US006427658B1

(12) United States Patent
Toyama et al.

(10) Patent No.: US 6,427,658 B1
(45) Date of Patent: Aug. 6, 2002

(54) OUTBOARD MOTOR

(75) Inventors: Takeshi Toyama; Naoki Kawasaki, both of Hamamatsu (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/570,177

(22) Filed: May 12, 2000

(30) Foreign Application Priority Data

May 12, 2000 (JP) ..... 09570177

(51) Int. Cl.[7] ..... F02F 7/00
(52) U.S. Cl. ..... 123/195 P; 123/196 W
(58) Field of Search ..... 123/195 R, 195 P, 123/195 H, 196 R, 196 W, 196 LP; 440/900, 88

(56) References Cited

U.S. PATENT DOCUMENTS 5,718,197 A * 2/1998 Tsunoda et al. ..... 123/196 W
5,752,866 A * 5/1998 Takahashi et al. ..... 440/88
5,870,991 A * 2/1999 Mineno ..... 123/196 R
6,062,928 A * 5/2000 Watanabe et al. ..... 440/88
6,264,515 B1 * 7/2001 Mineno et al. ..... 440/83
6,276,327 B1 * 8/2001 Fukuoka et al. ..... 123/196 W
6,286,476 B1 * 9/2001 Hiraoka et al. ..... 123/196 W

* cited by examiner

*Primary Examiner*—Tony M. Argenbright
*Assistant Examiner*—Hai H. Huynh
(74) *Attorney, Agent, or Firm*—Oblon, Spivak, McCelland, Maier & Neustadt, P.C.

(57) ABSTRACT

An outboard motor including an engine holder, an in-line multi-cylinder type engine disposed above the engine holder in a mounted usable state of the outboard motor, an oil pan disposed below the engine holder, and an engine cover covering the engine holder, engine and oil pan. The in-line multi-cylinder type engine includes vertically arranged cylinders and a crank chamber of a crank case corresponding to a lowermost cylinder has both shoulder portions formed by a wall section continuous to a wall section of the lowermost cylinder and extending in a direction normal thereto and another wall section substantially parallel to the wall section of the lowermost cylinder so as to define shapes of the shoulder portions to be substantially square in section.

4 Claims, 9 Drawing Sheets

OUTBOARD MOTOR

BACKGROUND Of THE INVENTION

1. Field of the Invention

The present invention relates to an outboard motor in which a four-stroke-cycle engine is mounted, and more particularly, to an outboard motor having a structure capable of smoothly returning an oil supplied for lubricating the four-stroke-cycle engine into an oil pan.

2. Prior Art

In general, in an outboard motor in a state mounted to a hull of a boat, ship or like, for example, an engine is mounted on the highest portion of the outboard motor with a crankshaft perpendicularly extending therein, the rotation of the crankshaft is transmitted to a propeller shaft through a drive shaft which extends in the downward direction to thereby drive a screw propeller provided at a rear end of the propeller shaft.

When an engine of an outboard motor is of four-stroke-cycle type, an oil pan is provided below the engine, an oil accumulated inside the oil pan is pumped up by an oil pump and supplied into the engine for lubrication and then, the oil flows downward in the engine by gravity and is returned into the oil pan from a plurality of oil-returning holes formed in a lower surface of the engine.

Meanwhile, a plurality of partition walls are provided in a juncture between a cylinder block and a crankcase of the engine so as to separate the cylinders from one another, thereby forming crank chambers as many as the cylinders in number, and the crankshaft is pivotally supported by a crank journal (bearing) formed on each partition wall. Therefore, each partition wall is formed with an oil-passing hole having such a size sufficient to allow the oil to flow downward by the partition wall. The oil passes through the oil-passing hole and drops into the crank chamber and the oil is returned into the oil pan from the lowermost crank chamber through the oil-returning holes of the lower surface of the engine (lower surface of the crankcase).

Conventionally, bottom surfaces of the crank chambers, i.e., the partition walls are set all the same in shape, and the crank chambers are also set all the same in volume.

However, even if the bottom surfaces of the crank chambers are the same in shape and volume, since a great amount of oil flows into the lowermost crank chamber from the upper crank chamber, all the oil is not discharged out from the lower crank chamber and oil tends to be accumulated therein. Furthermore, since the crankshaft rotates in the accumulated oil, there are provided not only a problem that the engine output is dissipated by viscous drag of the oil, but also a problem that oil temperature is increased, or the oil roughly stirred by the crankshaft and atomized issues from a breather exit together with blowby gas.

On the other hand, a flat plate-like member called engine holder to which the engine is mounted is formed with the oil-returning hole for returning the oil flowing down from the engine into the oil pan. In the engine holder, a pair of left and right upper mount units, which are connected to a clamp bracket fixed to a hull, is installed. Since each upper mount unit mainly comprises a rubber damper, in order to prevent the oil from splashing on the upper mount unit, the oil-passing hole can conventionally be formed only at a location away from the upper mount unit, and it is difficult to efficiently return the oil into the oil pan.

SUMMARY OF THE INVENTION

An object of the present invention is to substantially eliminate defects or drawbacks encountered in the prior art mentioned above and to provide an outboard motor to efficiently return an oil supplied for lubricating an engine, to avoid loss of engine output and temperature increase of the oil and to prevent the oil from issuing from a breather exit together with blowby gas.

This and other objects can be achieved according to the present invention by providing, in one aspect, an outboard motor comprising:

- an engine holder;
- an engine disposed above the engine holder in mounted usable state of the outboard motor;
- an oil pan disposed below the engine holder; and
- an engine cover covering the engine holder, the engine and the oil pan;
- said engine being an in-line multi-cylinder type and comprising:
  - a crankcase including a crank chamber in which a crankshaft extends vertically perpendicularly;
  - a cylinder block disposed rear side of the crankcase; and
  - a cylinder head disposed rear side of the cylinder block,
  - wherein the engine includes a plurality of vertically arranged cylinders and a crank chamber of a crank case corresponding to a lowermost cylinder has both shoulder portions each formed by a wall section continuous to a wall section of the lowermost cylinder and extending in a direction normal thereto and another wall section substantially parallel to the wall section of the lowermost cylinder so as to define corner shapes of the shoulder portions to be substantially square in section.

In a preferred embodiment of this aspect, the shoulder portions formed to the lowermost crank chamber and located on a leading side with respect to rotation of the crankshaft is formed with a rib extending upward along an inner wall surface of the crank chamber from a bottom portion thereof. The one shoulder portion located on the leading side of the rotation of the crankshaft is formed, at the bottom portion thereof, with an oil-return hole and the rib is projected within an outline of the oil-return hole.

According to the structure of this aspect, an area of the bottom surface of the lowermost crank chamber and volume of the lowermost crank chamber become greater than those of the upper crank chambers, a large number of oil-return holes can be formed in a bottom surface of the lowermost crank chamber. Therefore, the lowermost crank chamber can accommodate the large amount of oil flowing from the upper crank chambers, and the oil flowing into the lowermost crank chamber can be discharged out efficiently. Therefore, it is possible to prevent the crankshaft from rotating in the oil accumulated in the lowermost crank chamber, to prevent the output loss of the engine and the temperature increase of the oil and to remove detrimental effect that the oil is atomized and issued from the breather exit together with blowby gas.

In the lowermost crank chamber, the flow of oil flowing along a peripheral wall of the crank chamber together with the rotation of the crankshaft is stopped by the rib and guided downward, the oil does not easily remain in the crank chamber.

Furthermore, since the oil stopped by the rib and guided downward is returned into the oil pan through the oil returning hole smoothly, the oil can be returned to the oil pan more effectively.

In another aspect, there is provided an outboard motor comprising:

an engine holder;

an engine which is disposed above the engine holder in a mounted usable state of the outboard motor and which has a crankcase in which a crankshaft extends vertically perpendicularly;

an oil pan disposed below the engine holder; and a mount unit including upper and lower mount members formed to the engine holder, wherein the engine holder is formed with a mount fixing portion to which the upper mount member is inserted and fixed in the engine holder, the mount fixing portion having a shaft-hole shape extending horizontally, and an oil-return holes through which an oil returning from the engine passes are formed around the mount fixing portion as viewed in a plan view of the engine.

According to the structure of this aspect, there is no adverse possibility that the oil supplied for lubricating the engine will not splash onto the upper mount unit. Further, since the large number of oil-returning holes can be formed around the upper mount unit, it is possible to return the oil into the oil pan more efficiently.

In a further aspect, there is provided an outboard motor comprising:

an engine holder;

an engine which is disposed above the engine holder in a mounted usable state of the outboard motor and which has a crankcase in which a crankshaft extends vertically perpendicularly;

an oil pan disposed below the engine holder; and a transmission mechanism disposed to a lower surface side of the engine for transmitting rotation of the crankshaft to a cam shaft, the transmission mechanism including a driven sprocket and a chain, wherein the engine includes a cylinder head having a lower surface portion to which oil return holes are formed, the oil return holes are located outside of the driven sprocket and the chain of the transmitting mechanism as viewed in a plan view of the engine.

According to the structure of this aspect, oil poured from the oil-return hole of the lower surface of the cylinder head does not splash onto parts which move fast such as a driven sprocket and a chain of a chain transmitting mechanism and does not act as resistance, it is possible to avoid the output loss of the engine.

In a still further aspect, there is provided an outboard motor comprising:

an engine holder;

an engine disposed above the engine holder in a mounted usable state of the outboard motor;

an oil pan disposed below the engine holder; and an engine cover covering the engine holder, the engine and the oil pan, the engine being an in-line multi-cylinder type and comprising:

a crankcase including a crank chamber in which a crankshaft extends vertically perpendicularly;

a cylinder block disposed rear side of the crankcase; and a cylinder head disposed rear side of the cylinder block, wherein the engine includes a plurality of vertically arranged cylinders and a crank chamber of a crank case corresponding to an uppermost cylinder has both shoulder portions each formed by a wall section continuous to a wall section of the uppermost cylinder and extending in a direction normal thereto and another wall section substantially parallel to the wall section of the uppermost cylinder, the uppermost crank chamber and the cylinder head is communicated through a breather passage which is opened to one of the shoulders of the uppermost crank chamber and the uppermost crank chamber is formed with a rib-shaped peripheral wall rising from an inner surface of the shoulder portion so as to surround the opening of the breather passage.

In this aspect, preferably, the shoulder portions to which breather passage is formed is a shoulder portion of a trailing side one with respect to a rotation of the crankshaft.

According to the structure of this aspect, since the rib-like peripheral wall formed on the opening of the breather passage closer to the crank prevents the oil in the crank chamber from flowing into the breather passage, it is possible to avoid the loss of oil from the breather exit. Furthermore, since the flow of oil flowing along the peripheral wall of the crank chamber together with rotation of the crankshaft does not easily flow into the breather passage, it is possible to avoid the loss of the oil from the breather exit more efficiently.

The nature and further characteristic features of the present invention will be made more clear from the following descriptions made with reference to the accompanying drawings.

DESCRIPTION OF THE PREFERRED EMBODIMENTS

Figure 1:
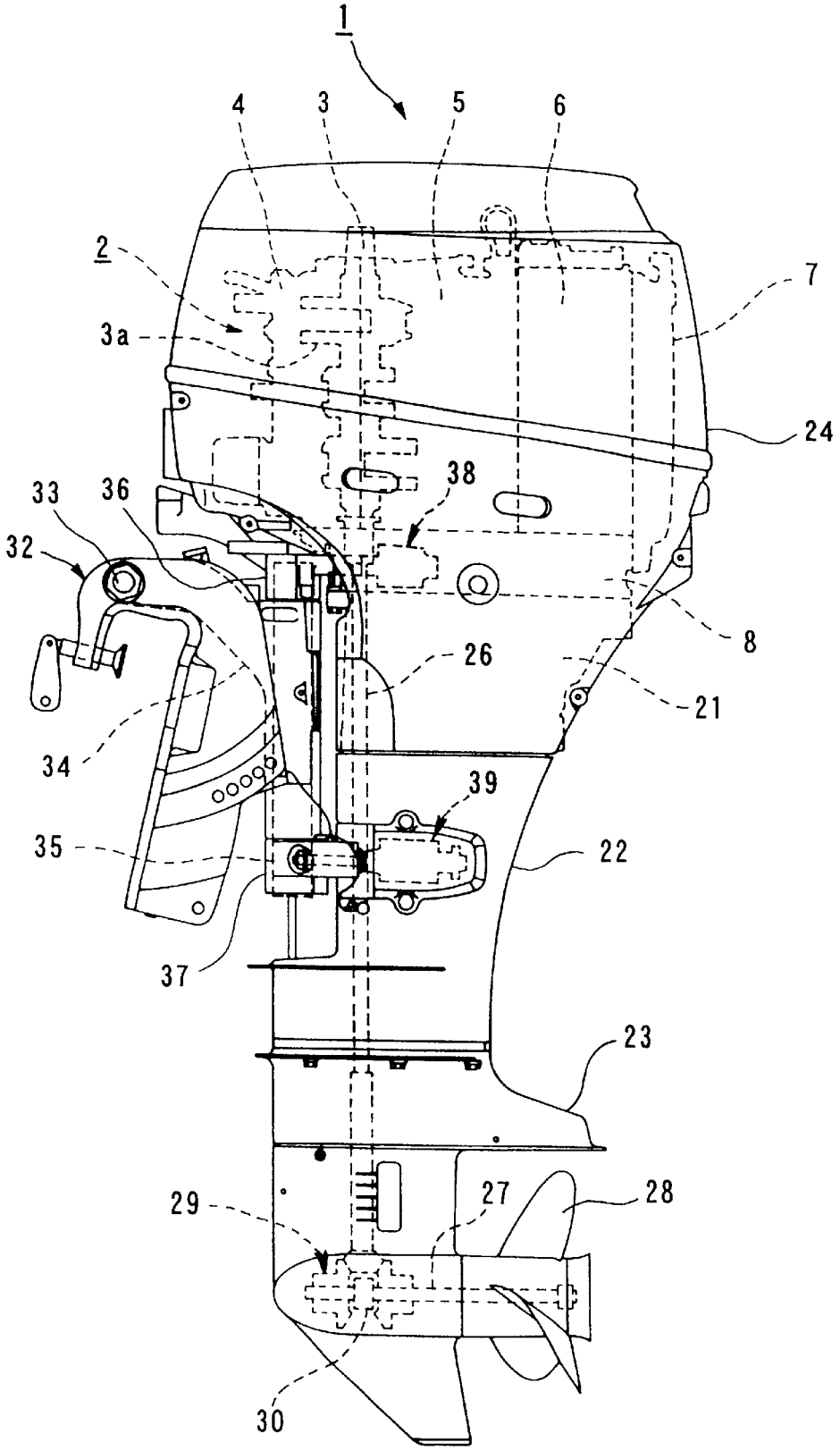
FIG. 1 is a left side view showing one example of an outboard motor of the present invention.

An embodiment of the present invention will be explained hereunder with reference to the drawings.

An engine 2 mounted in the uppermost portion of an outboard motor 1 is an in-line three-cylinder four-stroke-cycle engine for example. A crankshaft 3 of the engine 2 rises uprightly in the vertical direction, and as shown in FIGS. 2 to 5, a crankcase 4, a cylinder block 5, a cylinder head 6 and a head cover 7 are fixed on a flat plate-like engine holder 8 in this order from the forward direction of thereof, i.e. in a state of the outboard motor being mounted to a hull, for example, in a usable state. FIG. 6 is a top view of the engine holder 8.

A recoil starter 10 i(see FIG. 2) is disposed in an upper portion of the engine 2, and an electric generator unit 11 (see FIG. 3) is disposed in the recoil starter 10. An intake manifold 12 (see FIG. 3) is connected to a right side surface of the cylinder head 6, for example, and a throttle body 13 and an intake silencer 14 are connected forward of the intake manifold 12 in this order. Further, an exhaust device 15, an ignition device 16 and the like are provided on a left side surface of the cylinder head 6, and a starter motor 17 and an oil filter 18 are provided on a front portion of the crankcase 4.

On the other hand, an oil pan 21 is fixed to a lower surface of the engine holder 8. A drive shaft housing 22 and a gear housing 23 are fixed to a lower portion of the oil pan in this order. The engine 2, the engine holder 8 and the oil pan 21 are covered with an engine cover 24 in a waterproof manner.

A drive shaft 26 is connected to a lower end of the crankshaft 3 of the engine 2 integrally with the crankshaft 3 to be rotatable. The drive shaft 26 extends downward and vertically passes through the engine holder 8, the oil pan 21 and the drive housing 22, and reaches inside of the gear housing 23. A propeller shaft 27 is pivotally supported within the gear housing 23 in the horizontal (longitudinal) direction and is provided at its rear end with a screw propeller 28 so that the screw propeller 28 rotates in unison with the propeller shaft 27.

A bevel gear mechanism 29 and a clutch shifter 30 are provided at a portion at which the drive shaft 26 and the propeller shaft 27 are intersecting. The rotation of the drive shaft 26 is transmitted to the propeller shaft 27 through the bevel gear mechanism 29 so that the screw propeller 28 is rotated to generate propulsion. The direction of rotation of the drive shaft 26 is switched between normal direction and reverse direction, and the rotation thereof is transmitted to the propeller shaft 27 so as to select the forward and backward movements of the outboard motor 1 (i.e. hull).

The outboard motor 1 having the above-described structure is provided at its front portion with a clamp bracket 32 fixed to a stern plate of a boat or ship. The clamp bracket 32 is provided with a swivel bracket 34 through a tilt shaft 33 and a steering shaft 35, which is pivotally supported by the swivel bracket 34. The steering shaft 35 is provided at its upper end and lower end with an upper mount bracket (steering bracket) 36 and a lower mount bracket 37, respectively, to be integrally rotatable.

A pair of left and right upper mount units 38 provided in the vicinity of a front edge of the engine holder 8 are connected to the upper mount bracket 36. A pair of lower mount units 39 disposed on left and right opposite sides of the drive housing 22 are connected to the lower mount bracket 37. With this structure, a body of the outboard motor 1 can be turned (steered) leftward and rightward around the steering shaft 35 and can be tilted up around the tilt shaft 33 upward with respect to the bracket 32.

Figure 2:
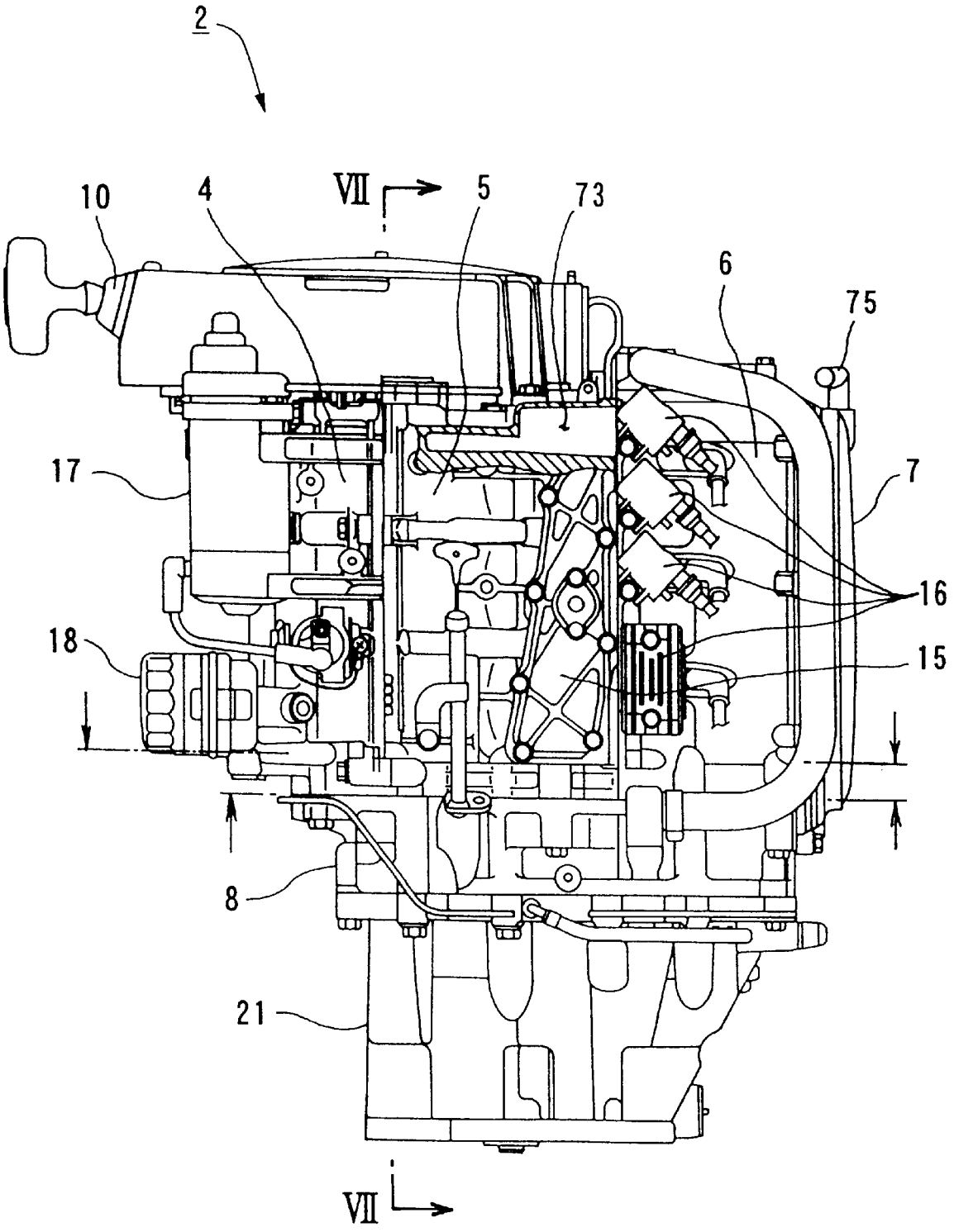
FIG. 2 is a left side view showing an arrangement of an engine, an engine holder and an oil pan of the outboard motor.
Figure 7:
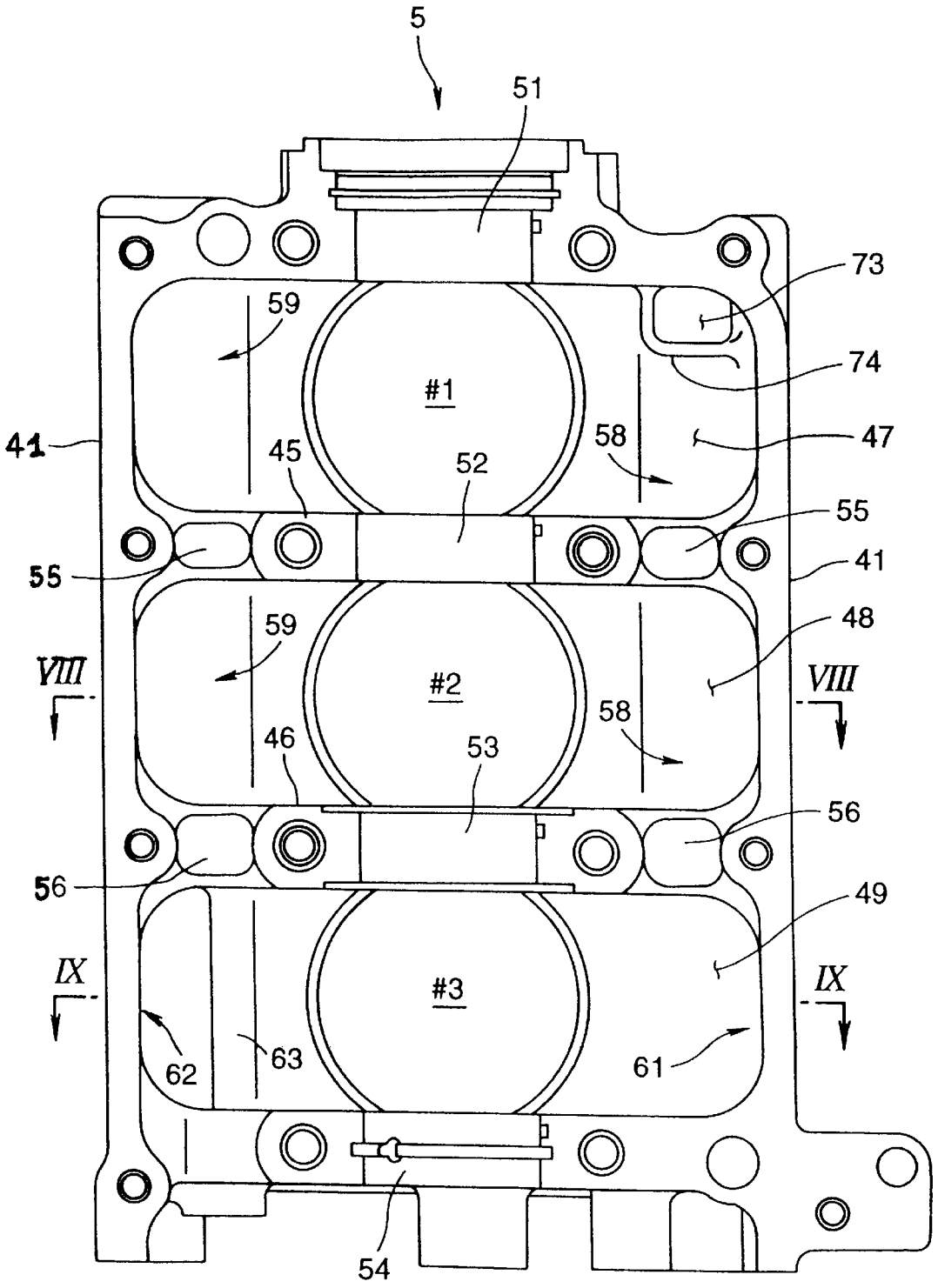
FIG. 7 is a front view of a cylinder block shown along the arrow VII—VII in FIG. 2.
Figure 8:
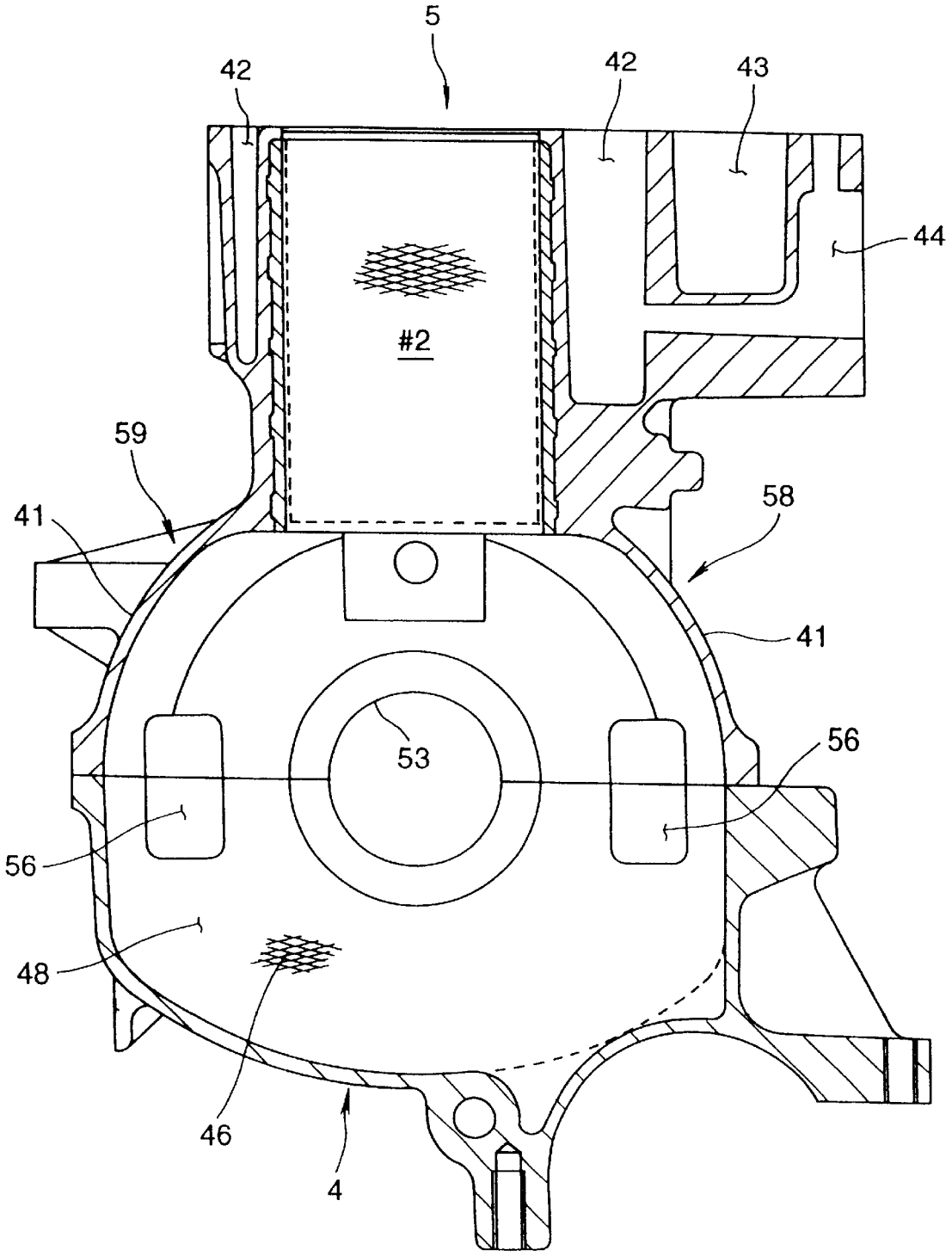
FIG. 8 is a transverse cross sectional view of a crankcase and the cylinder block taken along the line VIII—VIII in FIG. 7.
Figure 9:
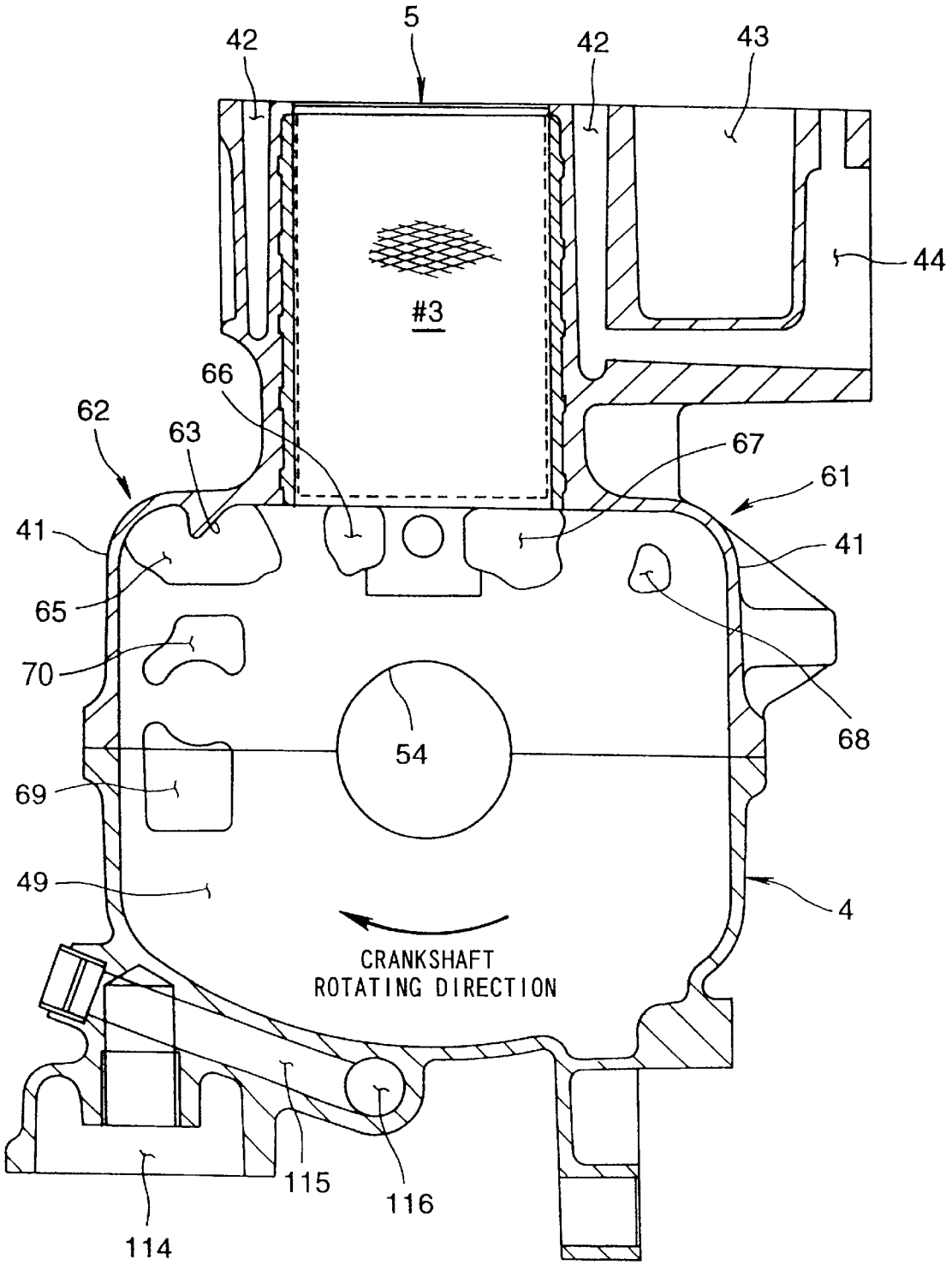
FIG. 9 is a transverse cross sectional view of the crankcase and the cylinder block taken along the line IX—IX in FIG. 7 and shows one embodiment of the present invention.

FIG. 7 is a front view showing the arrangement of the cylinder block 5 of the engine 2 as viewed from the arrow VII—VII in FIG. 2, FIGS. 8 and 9 are transverse cross sectional views of the crankcase 4 and the cylinder block 5 taken along the line VIII—VIII and the line IX—IX in FIG. 7, respectively.

In the cylinder block 5, three cylinders #1, #2 and #3 are vertically arranged so that their axes extend horizontally. Further, a skirt portion 41 is formed so as to spread leftward and rightward from front ends of the cylinders #1, #2 and #3 and extend forward. A water jacket 42 for circulating cooling water is formed around each of the cylinders #1, #2 and #3. The cylinder block 5 is formed at its left side surface, for example, with an exhaust passage 43 (see also FIGS. 4 and 5) and a water jacket 44 for cooling the exhaust passage 43.

The crankcase 4 is aligned with the skirt portion 41 of the cylinder block 5 and a space therebetween is partitioned by two horizontal partition walls 45 and 46 to define three crank chambers 47, 48 and 49 respectively corresponding to the three cylinders #1, #2 and #3. The partition walls 45 and 46 are respectively formed with crank journals 52 and 53. The crankcase 4 and the cylinder block 5 are formed at their upper and lower surfaces with crank journal 51 and 54, and the crankshaft 3 is rotatably supported by four crank journals 51, 52, 53 and 54. Further, oil-passing holes 55 and 56 are formed on left and right opposite sides of the crank journals 52 and 53 of the partition walls 45 and 46.

As shown in FIG. 8, in the uppermost and intermediate crank chambers 47 and 48, the skirt portion 41 is formed such that its opposite shoulders 58 and 59 are curved roundly around the crank journal 53 (51, 52) so as to form round shoulders. On the other hand, in the lowermost crank chamber 49, the skirt portion 41 is formed angularly such that its opposite shoulders 61 and 62 are sharpened so as to provide substantially a square shape. Transverse cross sections of the lowermost crank chamber 49 and the lowermost cylinder #3 are formed into substantially convex shapes. A transverse cross section of the crankcase 4 is formed into a rounded shape uniformly from its uppermost portion to its lowermost portion. In this embodiment, the shoulder portions formed to each of the crank chambers are portions defined by a wall section continuous to the wall section of the cylinder and normal thereto and a wall section parallel to the wall section of the cylinder.

Further, the shoulder 62, of both the shoulders 61 and 62 of the lowermost crank chamber 49, located on the leading side with respect to the rotation of the crankshaft 3, i.e., the shoulder 62 that a crank web 3*a* (see FIG. 1) of the crankshaft 3 which rotates as viewed from the lowest cylinder #3 approaches, is formed with a rib 63 extending upward along an inner wall surface of the shoulder 62 from a bottom surface (i.e., a lower surface of the cylinder block 5) of the crank chamber 49.

Figure 4:
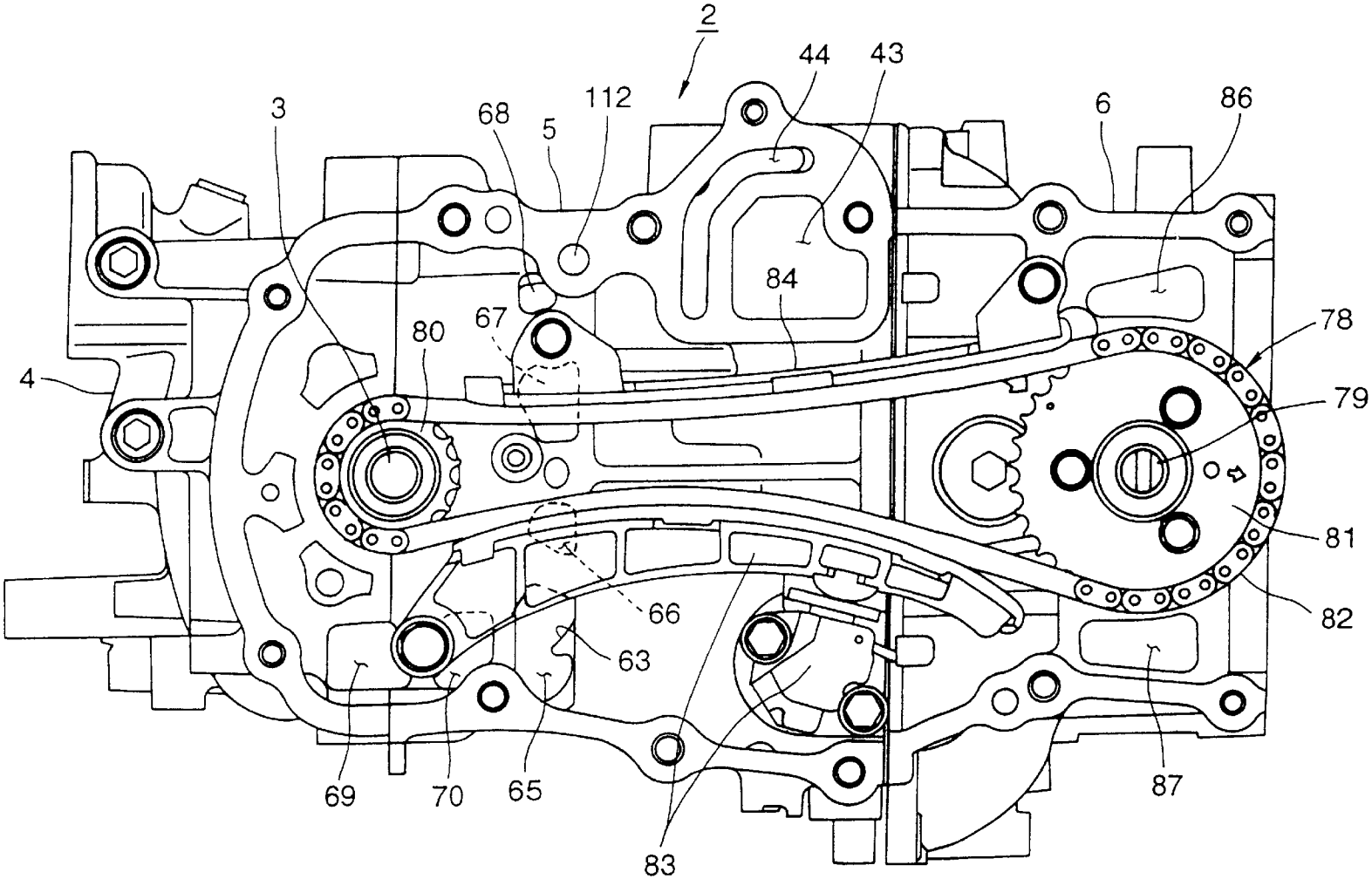
FIG. 4 is a bottom view of the engine shown along the arrow IV—IV in FIG. 2.

As also shown in FIG. 4, the bottom surface of the crank chamber 49 is formed with a plurality of oil-returning (oil-return) holes 65 to 70, and as shown in FIG. 9, the oil-returning hole 65 is formed at a location of the shoulder 62 on the leading side with respect to the (clockwise) rotation of the crankshaft 3. The rib 63 is projected within the outline of the oil-returning hole 65 as viewed on a plane.

Figure 3:
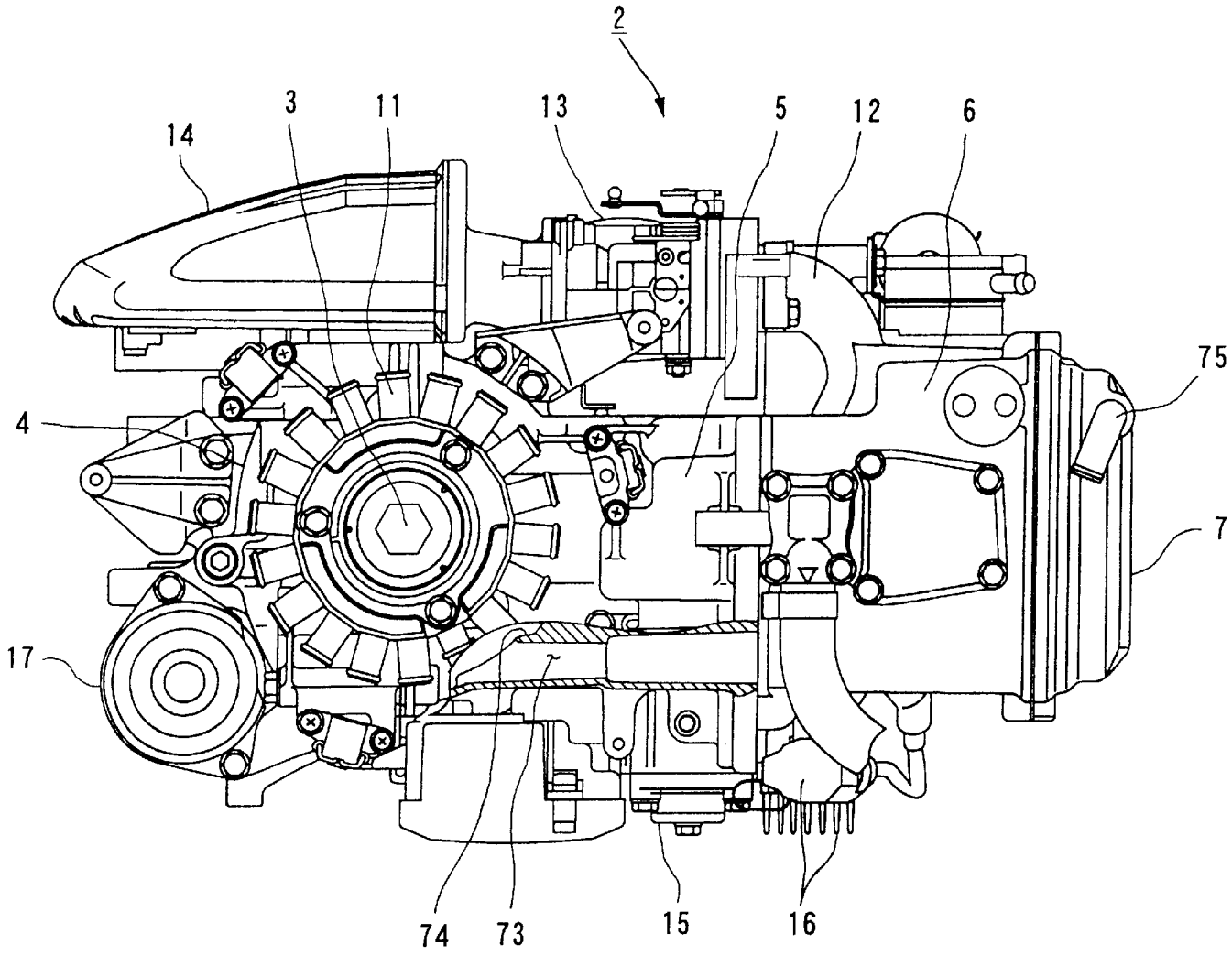
FIG. 3 is a top view of the engine.

As shown in FIGS. 2, 3 and 7, a breather passage 73 is formed within the cylinder block 5. The breather passage 73 brings the uppermost crank chamber 47 and the interior of the cylinder head 6 into communication with each other. An opening of the breather passage 73 on the side of the crank chamber 47 is located at the shoulder 58 closer to the trailing side with respect to the rotation of the crankshaft 3 and is surrounded by a rib-like peripheral wall 74 rising from an inner surface of the shoulder 58.

Although the uppermost crank chamber 47 is in communication with the interior of the cylinder head 6 through the breather passage 73 in this manner, since other crank chambers 48 and 49 are in communication with the uppermost crank chamber 47 through the oil-returning holes 55 and 57 formed in the partition walls 45 and 46, respectively, all the crank chambers 47, 48 and 49 are in communication with the interior of the cylinder head 6. On the other hand, the head cover 7 is provided at its upper portion with a breather union 75 to which a breather hose, not shown, is connected, and the other end of the breather hose is connected to an intake silencer 14.

As shown in FIG. 4, the engine 2 is provided at its lower surface with a chain transmitting mechanism 78. The chain transmitting mechanism 78 is for transmitting the rotation of the crankshaft 3 to a cam shaft 79 (see FIG. 4) pivotally supported in the cylinder head 6, and the chain transmitting mechanism 78 comprises a drive sprocket 80 mounted to a lower end of the crankshaft 3 so that the drive sprocket 80 rotates integrally with the crankshaft 3, a driven sprocket 81 mounted to a lower end of the cam shaft 79 so that the driven sprocket 81 rotates integrally with the cam shaft 79, a chain 82 engaged around these two sprockets 80 and 81, a chain tensioner 83 for adjusting a tension of the chain 82 and a chain guide 84 for stabilizing a running passage of the chain 82.

The cylinder head 6 is formed at its lower surface with a pair of left and right oil-returning holes 86 and 87. These oil-returning holes 86 and 87 are disposed outside of the chain 82 such that the oil-returning holes 86 and 87 are not superposed on the driven sprocket 81 and the chain 82 of the chain transmitting mechanism 78 as viewed on a plane.

On the other hand, as shown in FIG. 6, the engine holder 8 is formed at its front portion with a shaft hole 89 through which the drive shaft 26 is inserted, and a pair of left and right mount fixing portions 90 are formed so as to sandwich the shaft hole 89. Each of the left and right mount fixing portions 90 is formed into a shaft hole shape extending horizontally rearward from a front edge of the engine holder 8, and the upper mount unit 38 is inserted and fixed in the mount fixing portion 90.

As viewed on a plane, a plurality of oil-returning holes 92 to 96 are formed around the mount fixing portion 90, and a large number of oil-returning holes 97 to 103 are formed in a rear half of the engine holder 8. Further, the engine holder 8 is provided at its rear portion with an oil pump 105. An oil suction passage 106 and an oil discharge passage 107 are formed so as to be connected to the oil pump 105. An oil strainer 108 connected to the side of the entrance of the oil suction passage 106 extends downward to the bottom of the oil pan 21. On the other hand, the oil discharge passage 107 extends diagonally from the oil pump 105 and is connected to a vertical oil passage 109 provided on the left side of the engine holder 8.

If the engine 2 is disposed on the engine holder 8, a main shaft 111 of the oil pump 105 is fitted into the lower end of the cam shaft 79 of the engine 2 such that the main shaft 111 rotates integrally with the cam shaft 79 so that the oil pump 105 is driven by the cam shaft 79 when the engine 2 is operated. The vertical oil passage 109 of the engine holder 8 is aligned with a vertical oil passage 112 (see FIG. 4) which is opened at a lower surface of the engine 2 (cylinder block 5).

Figure 5:
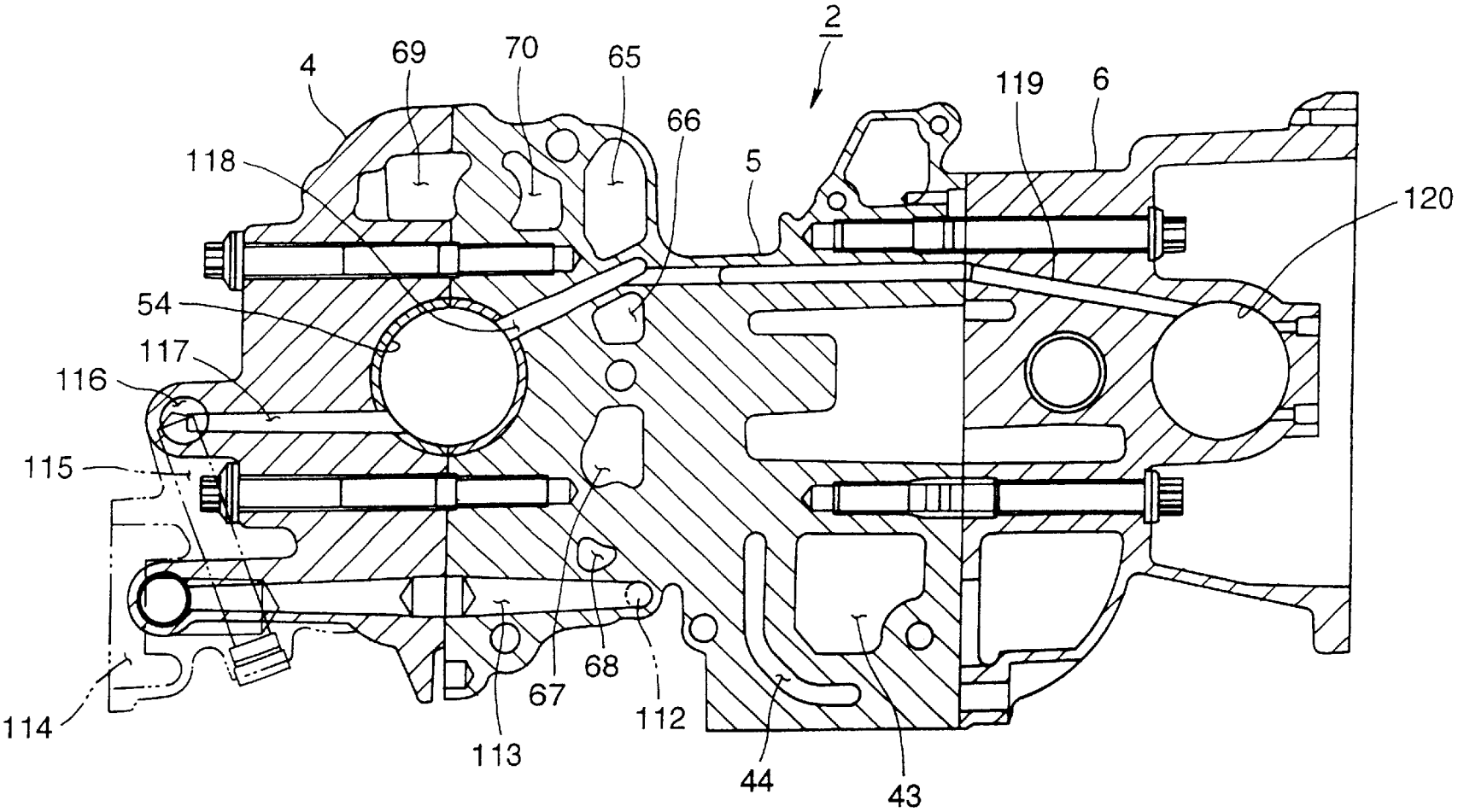
FIG. 5 is a transverse cross sectional view of the engine taken along the line V—V in FIG. 2.
Figure 6:
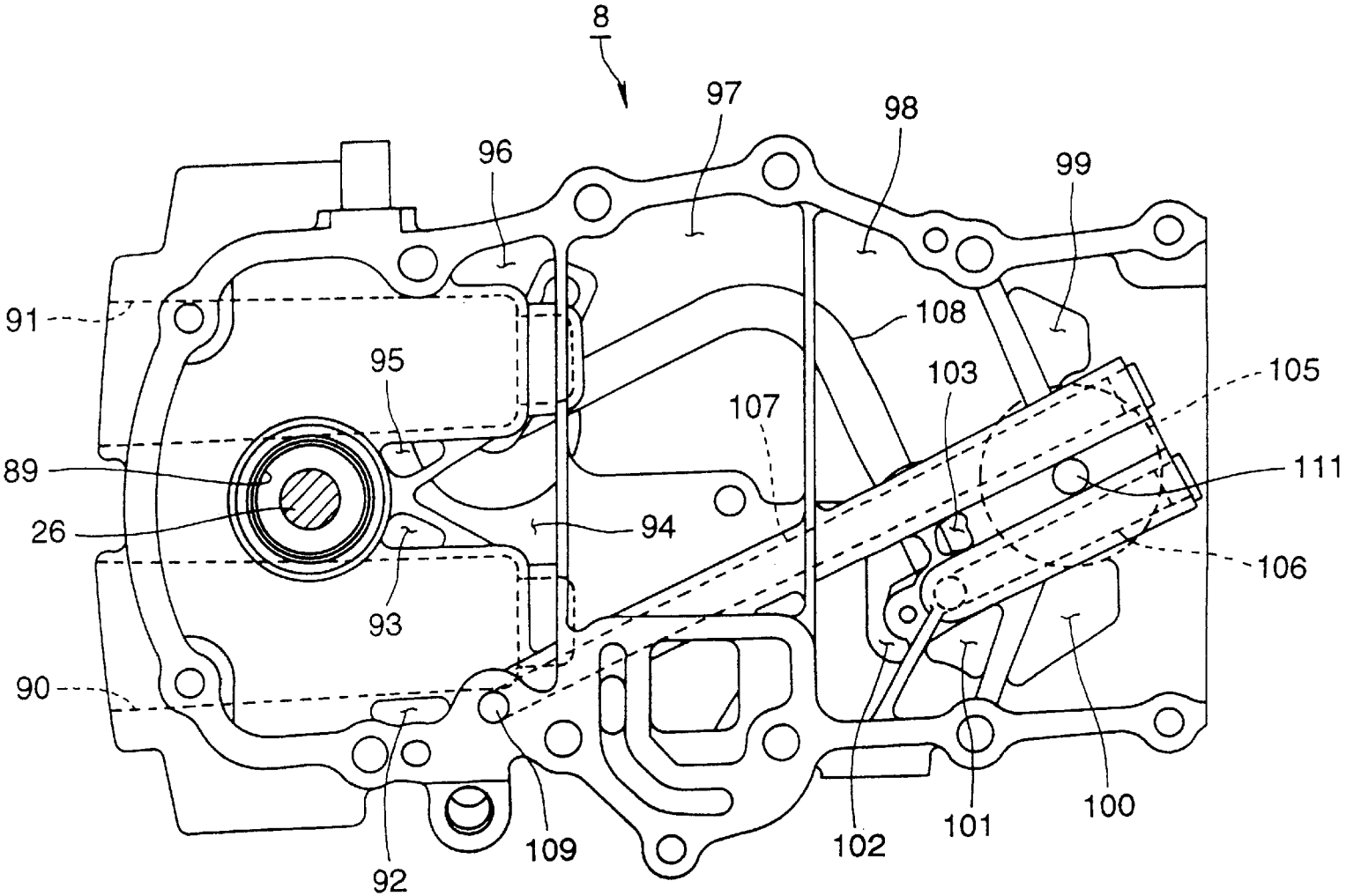
FIG. 6 is a top view of the engine holder.

As shown in FIG. 5, the vertical oil passage 112 is in communication with one lend of a lateral oil passage 113 which is formed horizontally from the cylinder block 5 to the crankcase 4. The other end of the lateral oil passage 113 is connected to an oil filter chamber 114, and another lateral oil passage 115 (see FIG. 9) extending from the oil filter chamber 114 is connected to a main gallery 116. The oil filter chamber 114 is provided with the oil filter 18.

The main gallery 116 extends upward along a front surface of the crankcase 4, and four crank journal passages 117 bifurcated from the main gallery 116 are respectively connected to the crank journals 51 to 54. In the cylinder block 5, a head oil passage 118 extending from the lowermost crank journal 54 towards the cylinder head 6 is formed. The head oil passage 118 is connected to a cam journal passage 119 formed in the cylinder head 6, and the cam journal passage 119 is connected to a cam journal 120. The cam shaft 79 is pivotally supported in the cam journal 120.

When the engine 2 is operated and the oil pump 105 is driven, the oil accumulated in the oil pan 21 is pumped up into the oil pump 105 through the oil strainer 108 and the oil suction passage 106. The oil discharged into the oil pump 105 enters into the oil filter chamber 114 through the oil discharge passage 107, the vertical oil passages 109, 112 and the lateral oil passage 113 and is then filtered by the oil filter 18. The filtered oil is supplied to the crank journals 51 to 54 through the lateral oil passage 115, the main gallery 116 and the crank journal passage 117. The oil lubricates the crank journals 51 to 54 and is supplied to the cam journal 120 through the head oil passage 118 and the cam journal passage 119 for lubricating the cam journal 120.

A portion of the oil lubricating the crank journals 51 to 54 is supplied for lubricating a large end of a connecting rod through an oil passage, not shown, formed in the crankshaft 3, and further, this oil portion is sprayed to the cylinders #1, #2 and #3 and to inner surfaces of pistons, thereby lubricating and cooling them. The oil used for lubricating and cooling the crank journals 51 to 54, the large end portion of the connecting rod, the cylinders #1, #2 and #3 and!the piston drops downward within the crank chambers 47, 48 and 49 by the gravity, and then, flows downward from the oil-returning hoes 65 to 70.

A large amount of oil flows into the lowermost crank chamber 49 from the upper crank chambers 47 and 48 through the oil-passing holes 155 and 56 of the partition walls 45 and 46. However, since an area of a bottom surface of the lowermost crank chamber 49 and volume of the lowermost crank chamber 49 are set greater than those of the upper crank chambers 47 and 48, the lowermost crank chamber 49 can accommodate the large amount of oil. Furthermore, since the large number of oil-returning holes 65 to 70 are formed in the wide bottom surface, the oil flowing into the crank chamber 49 is returned into the oil pan 21 efficiently.

Therefore, there will not occur a situation in which a liquid level of the oil flowing into the lowermost crank chamber 49 is increased and the crankshaft 3 rotates in the oil, and the output power loss of the engine 3 and the temperature increase of the oil are not caused. Further, since the oil in the lowermost crank chamber 49 is not stirred roughly by the crankshaft 3, there is no adverse possibility that the oil is atomized and discharged from the breather passage 73 as it is.

Further, although the oil flowing into the lowermost crank chamber 49 tends to flow along the peripheral wall of the crank chamber 49 in accordance with the rotation of the crankshaft 3, this oil flow is stopped by the rib 63 formed on the shoulder 62 located on the leading side with respect to the rotation of the crankshaft 3 and guided downward, and the oil is smoothly discharged from the oil-returning hole 65 formed directly below the rib 63. In this manner, it is possible to positively discharge the oil and to prevent the oil from remaining in the crank chamber 49.

On the other hand, the oil which has lubricated the cam journal 120 in the cylinder head 6 is supplied to a valve moving mechanism, not shown, through an oil passage formed in the cam shaft 79 and, then, flows downward from the oil-returning holes 86 and 87 opened at the lower surface of the cylinder head 6. However, since the oil-returning holes 86 and 87 are located outside of the driven sprocket 81 and the chain 82 of the chain transmitting mechanism 78 as viewed on a plane, the oil dropping from the oil-returning holes 86 and 87 will not be soused over the driven sprocket 81 and the chain 82. Thus, the output loss of the engine 2 can be prevented.

In this manner, the large amount of oil flowing downward from the lower surface of the engine 2 is returned into the oil pan 21 through the large number of oil-returning holes 92 to 103 formed in the engine holder 8. In the engine holder 8, its mount fixing portion 90 is formed into the shaft hole shape extending in the horizontal direction, and the oil-returning holes 92 to 96 are formed around the mount fixing portion 90. Therefore, there is no adverse possibility that the oil flowing downward from the engine 2 is soused over the upper mount unit 38, and it is possible to efficiently return the oil into the oil pan 21.

On the other hand, the blowby gas leaking from gaps between the cylinders #1, #2 and #3 and the pistons into the crank chambers 47 to 49 flows into the cylinder head 6 from the breather passage 73 and flows into the intake silencer 14 from a breather, not shown, formed like a labyrinth inside the head cover 7 through the breather union 75 and the breather hose. The blowby gas is again drawn into the engine 2 and burnt there. As described above, the opening of the breather passage 73 closer to the crank chamber 47 is opened at the shoulder 58 of the crank chamber 47 and is surrounded by the rib-like peripheral wall of the clank chamber 74 rising from the inner surface of the shoulder 58. Therefore, when the blowby gas in the crank chambers 47, 48 and 49 flows into the opening of the breather passage 73, the oil in the crank chambers 47, 48 and 49 does not easily flow into the breather passage 73 together with the blowby gas.

Further, since the shoulder 58 at which the breather passage 73 is opened is on the trailing side with respect to the rotation of the crankshaft 3, the oil flowing along the peripheral wall 74 together with the rotation of the crankshaft 3 does not easily enter the breather passage 73, and it: is possible to extremely effectively prevent the flowing loss of the oil from the breather union 75.

As explained above, according to the outboard motor of the present invention, it is possible to efficiently return oil supplied for lubricating an engine into an oil pan, to avoid the output loss of the engine and the temperature increase of the oil and to prevent the oil from issuing from the breather exit together with the blowby gas.

What is claimed is:

1. An outboard motor comprising:

an engine holder;

an engine disposed above the engine holder in a mounted usable state of the outboard motor;

an oil pan disposed below the engine holder; and an engine cover covering the engine holder, the engine and the oil pan, said engine being an in-line multi-cylinder type and comprising:

a crankcase including a crank chamber in which a crankshaft extends vertically perpendicularly;

a cylinder block disposed rear side of the crankcase; and a cylinder head disposed rear side of the cylinder block, wherein said engine includes a plurality of vertically arranged cylinders and a crank chamber of a crank case corresponding to a lowermost cylinder has both shoulder portions each formed by a wall section continuous to a wall section of the lowermost cylinder and extending in a direction normal thereto and another wall section substantially parallel to the wall section of the lowermost cylinder so as to define shapes of said shoulder portions to be substantially square in section.

2. An outboard motor according to claim 1, wherein one of said shoulder portions formed to the lowermost crank chamber and located on a leading side with respect to rotation of the crankshaft is formed with a rib extending upward along an inner wall surface of the crank chamber from a bottom portion thereof.

3. An outboard motor according to claim 2, wherein said one shoulder portion located on the leading side of the rotation of the crankshaft is formed, at the bottom portion thereof, with an oil-return hole and said rib is projected within an outline of said oil-return hole.

4. An outboard motor comprising:

an engine holder;

an engine which is disposed above the engine holder in a mounted usable state of the outboard motor and which has a crankcase in which a crankshaft extends vertically perpendicularly;

an oil pan disposed below the engine holder; and a transmission mechanism disposed to a lower surface side of the engine for transmitting rotation of the crankshaft to a cam shaft, said transmission mechanism including a driven sprocket and a chain, wherein said engine includes a cylinder head having a lower surface portion to which oil return holes are formed, said oil return holes are located outside of the driven sprocket and the chain of said transmitting mechanism as viewed in a plan view of the engine.

* * * * *

UNITED STATES PATENT AND TRADEMARK OFFICE

CERTIFICATE OF CORRECTION

PATENT NO. : 6,427,658 B1
DATED : August 6, 2002
INVENTOR(S) : Toyama et al.

It is certified that error appears in the above-identified patent and that said Letters Patent is hereby corrected as shown below:

Title page,
Item [30], Foreign Application Priority Data should read:

-- [30] Foreign Application Priority Data
May 13, 1999 (JP) ……...11-133320 --

Signed and Sealed this

Eleventh Day of February, 2003

JAMES E. ROGAN
*Director of the United States Patent and Trademark Office*